US005243256A

United States Patent [19]

Holzer

[11] Patent Number: 5,243,256

[45] Date of Patent: Sep. 7, 1993

[54] GAS DISCHARGE BASIN FOR COMPACT LAMPS

[76] Inventor: Walter Holzer, Drosteweg 19, 7758 Meersburg, Fed. Rep. of Germany

[21] Appl. No.: 754,076

[22] Filed: Sep. 3, 1991

[30] Foreign Application Priority Data

Sep. 3, 1991 [DE] Fed. Rep. of Germany ..... 4027783

[51] Int. Cl.[5] ..... H01J 17/16; H01J 61/30

[52] U.S. Cl. ..... 313/493; 313/610; 313/634

[58] Field of Search ..... 313/493, 610, 634; 315/DIG. 1, DIG. 5

[56] References Cited

U.S. PATENT DOCUMENTS 1,188,194 6/1916 Moore ..... 313/610

4,260,931 4/1981 Wesserlink et al. ..... 313/493

4,445,069 4/1984 van Amstel ..... 313/493

4,455,508 6/1984 Wesselink ..... 313/493 X 4,835,440 5/1989 Imamura et al. ..... 313/493 X

*Primary Examiner*—Sandra L. O'Shea

*Attorney, Agent, or Firm*—Paul H. Gallagher

[57] ABSTRACT

A gas discharge compact lamp having a single outer tube and a single inner tube concentrically arranged and sealed in the outer tube, forming a gas discharge space therebetween, of maximum 12 mm dimension, the tubes being at least partially transparent. A segmented ring shaped electrode is positioned in that gas discharge space, and a second electrode in a single location. Additional electrodes are provided for heating the main electrodes.

11 Claims, 1 Drawing Sheet

GAS DISCHARGE BASIN FOR COMPACT LAMPS

BRIEF SUMMARY OF THE INVENTION

Gas discharge compact lamps, also called economy lamps, because of their small current consumption, are in recent years much more in demand, moving from about fifth place to compare with incandescent lamps.

Unfortunately the previous constructions possessed several serious disadvantages, such as an essentially greater length than the incandescent lamps, and they necessitated expensive electronic fluorescent lamp ballasts in order to start the lamps and to curb their electric current consumption, which often led to clumsy and awkward construction.

An object of the present invention is to achieve the greatest possible lighting surface with the most concise construction, and at the least expense.

Conventional compact lamps almost exclusively use thin tubes of about 10 to 12 mm diameter, which are positioned and joined as several rods arranged parallel, but connected in series.

Figure 2:
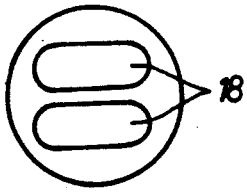
FIG. 2 is an end view from the bottom of FIG. 1.
Figure 4:
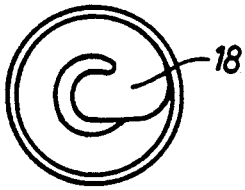
FIG. 4 is an end view from the bottom of FIG. 3.
Figure 1:
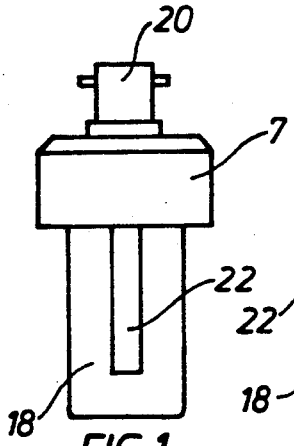
FIG. 1 is a side view of a known kind of gas discharge compact lamp.
Figure 3:
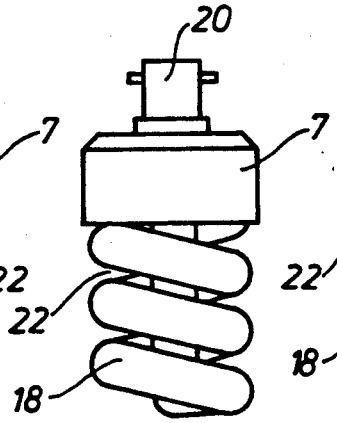
FIG. 3 is a side view of another form of lamp.

FIGS. 1 and 2 present such a known arrangement. A better solution can be achieved with a coiled design of the tubes 18 as is presented in FIGS. 3 and 4. In the latter case, with the same construction size, there is greater tube length and thereby higher capacity.

Figure 6:
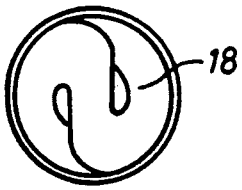
FIG. 6 is an end view from the bottom of FIG. 5.
Figure 8:
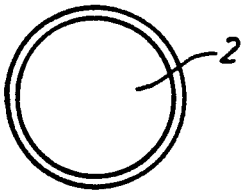
FIG. 8 is an end view from the bottom of FIG. 7.
Figure 5:
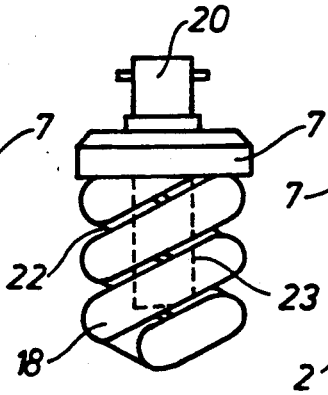
FIG. 5 is a side view of another form of lamp.

FIGS. 5 and 6 show a further improvement in which the interior space of the helix of tube 18 is so shaped that at least parts of the fluorescent lamp ballast 23 can be housed in the center of the tube coil, which allows either a shortened design of the lamp with the same capacity, or a higher capacity with the same construction length.

All of the described designs have the same advantage that between the tubes or tube elements non-lighted zones exist and the tubes overlap and thereby shade each other.

To overcome the stated disadvantages, the invention provides the construction of the gas discharge basin of the compact lamp with an outer shell 2, which corresponds approximately to the outer diameter of the compact lamp, this shell replacing the combination of thin tubes that were used previously, whereby the necessary electrode connections are so arranged that they can be directly, but detachably, connected with the fluorescent lamp ballast to a complete compact lamp.

With such an arrangement a continuous light surface with the best use of the surface, is achieved. This eliminates the previously existing gaps between the tube elements, and the continuous outer shell can be easily cleaned, which is practically impossible in the case of the previous compact lamps with spaced tube elements, the latter soon leading to light loss.

For optimum design of the gas discharge basin and its equal division, an arrangement is provided in which the first electrode 3 of the two necessary electrodes is placed on one side of the outer shell 2, and a second electrode 5 is placed on the opposite side of the outer shell, whereby its connection 6 is directed to the outside through sealed, centrally positioned interior tube 8, preferably in direction of the connection 4 of the first electrode 3.

The diameter of the inner tube 8 is so chosen, in carrying out the invention, that between that tube and the outer shell 2 it has an optimum distance of a maximum 12 mm. According to the invention that dimension insures good characteristics of the gas discharge, but also accommodates parts of the fluorescent lamp ballast 7 inside the inner tube 8 and results in favorable construction sizes of the compact lamp.

The construction according to the invention is also cost effective, since only the interior of the outer shell 2 is coated with a luminous coating 9, which is expensive. The inner tube 8 need not be provided with a luminous coating, but instead it may be provided with a good reflective coating, which increases the intensity of the radiation of the luminous coating.

An interior electrically conducting coating on the inner tube 8 can by means of its electrostatic influence aid the ignition, constituting an advantage of the invention. Such an invisible coating to aid in ignition, cannot be applied in previous constructions.

The angularly symmetrical form of gas discharge basin, according to the invention, enables and facilitates the use of ring shaped electrodes. The electrode 3 can especially be advantageously constructed as a wire ring, or as a coiled wire ring with heated electrodes, or also as a vapor deposited conducting layer, which even allows simple heating in a known fashion.

Under certain conditions requiring high quality, it is suitable to divide the ring electrodes 10 into several segments 11 each with a connection 12.

These segments can be switched by the fluorescent lamp ballast either cyclically in quick succession, or together, or in groups, by means of electrical coupling elements 13. The coupling elements 13 may be inductive, as well as ohmic or capacitive connections, which because of the use with cathode evaporation of the segments 11, the coupling elements can be especially simply and cheaply produced.

The invention includes the feature of homogenizing the discharge, by providing at least one electrode with an ionizing chamber or cavity 14. In the working of the alternating current, such an ionizing chamber aids in the retention of the discharge, but also provides a better spatial division of the same.

FIGS. 1 to 6 show previous known forms of compact lamps, which mostly included tube lamps 18 in rod or coil form. The photometrically unused interstices 22 are shown, and it will be noted that overlapping tube lamp elements 18 produce mutual shadowing.

The design of FIG. 5 shows a shorter lamp longitudinally, in which one part 23 of the fluorescent lamp ballast 7 extends into the helix.

In all examples the fluorescent lamp ballast 7 is securely joined with the base 20 which is inserted into a mounting.

Figure 7:
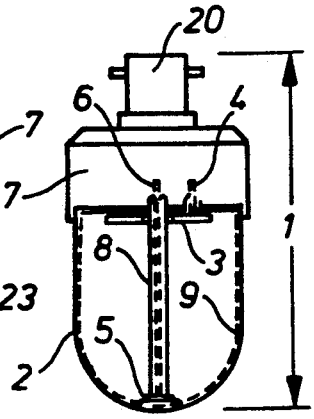
FIG. 7 is a semidiagramatic view from the side, partially in elevation and partially in section of a lamp embodying the features of the present invention.

FIG. 7 is a sectional view of a compact lamp with a gas discharge basin, of the invention. The tightly sealed outer shell 2 can be attached to the fluorescent lamp ballast 7 to the connections 4 and 6 which connect both electrodes 3 and 5 with the fluorescent lamp ballast 7. In this view, connection 4, 6 is drawn as a simple plug-type connection, but other forms of connection, such as bayonet connection, are possible.

The arrangement of the second electrode 5 at the under side of the inner tube 8 provides an even formation of the gas discharge basin. The appertaining connection 6 is connected with the electrode 5 in the inner tube 8.

Figure 9:
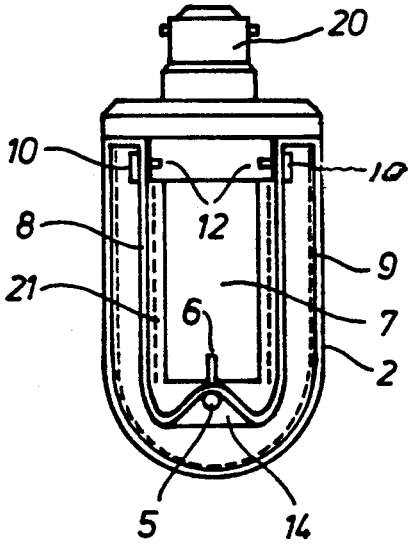
FIG. 9 is a semidiagramatic view from the side of another form of the invention.

FIG. 9 shows another, and improved, form of gas discharge basin, according to the invention. In this form the volume of the discharge space is reduced by the larger radius of the inner tube 8. The distance between inner tube 8 and outer shell 2 is reduced. Economical evacuation and filling with gas results.

The inner tube 8 is provided with a coating 21 which results in several objectives. As an electrically conducting layer, it increases the capacity of the ignition behavior of the gas discharge. As a good reflective layer, it reflects the ultraviolet radiation that enters the gas discharge space and stimulates the luminous coating 9 to a more intense light emission. A greater light efficiency results.

Since only the outer shell 2 has a luminous coating, only the outer end surfaces that are very light, are coated, and previously covered or shadowed surfaces are not unnecessarily coated with the very expensive luminous substance. A further reduction of costs is the result.

The electrode 10 is schematically shown in FIG. 9 as vacuum evaporated, and ring shaped with connections 12 has direct connection with the fluorescent light ballast 7, which is also joined with the electrode 5 by way of the connection 6.

The schematically represented cavity 14 in the region of the electrode 5 also facilitates the gas discharge. It presents an ionizing chamber which allows a corresponding function.

As shown in FIG. 9, as a result of positioning the housing parts of the fluorescent lamp ballast 7 in the inner tube 8, the entire construction size of the compact lamp 1 is reduced.

Figure 10:
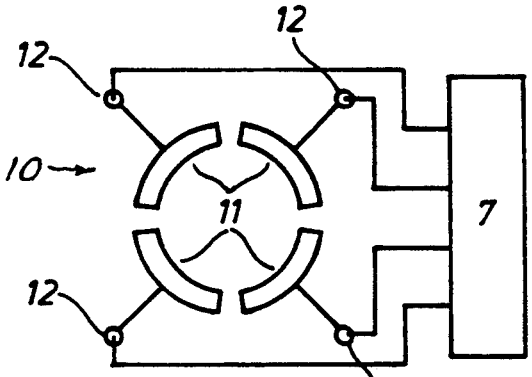
FIG. 10 is a wiring diagram of the form of FIG. 9.

FIG. 10 shows a schematic wiring diagram of a ring shaped electrode 10 which is divided into several segments 11. Each segment 11 has a connection 12 with the fluorescent lamp ballast 7. The fluorescent lamp ballast 7 switches the individual segments in quick cyclical succession, so that the regions of the gas discharge attached to the segments 11 have flicker-free impaction.

Figure 11:
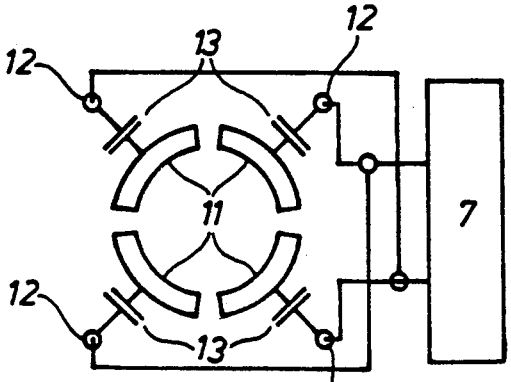
FIG. 11 is another form of wiring diagram.

FIG. 11 shows another arrangement for triggering the segments 11. In this form the segments 11 are connected by means of coupling elements 13, so that they can work independently of each other.

From the examples given above, the concepts of the invention are easily appreciated and the overall design of the invention is clear. All previously known and common constructions can be used without limitation, whether for example, a plug-type connection, or in connection with the wiring diagram of the electronic fluorescent lamp ballast, or the various different brackets for fluorescent tubes. The materials used for the components, whether glass, synthetics or metal, are also allowed in the construction.

I claim:

1. A compact lamp comprising
a cylindrical base (20) including a ballast (7)
a cylindrical outer shell (2) of substantially the same diameter as the base secured to the base and having a dome shaped end opposite the base,
a hollow cylindrical inner tube (8) mounted on the base and extending into the outer shell concentrically therewith,
the outer shell and inner tube, together with the base, forming a gas-discharge chamber therebetween,
electrodes (3, 5) at the axially opposite ends of the gas-discharge chamber, one of the electrodes (3) having a connection (4) extending into the base, and the other electrode (5) having a connection (6) extending through the inner tube into the base, and
the lamp having a fluorescent coating (9).

2. A compact lamp according to claim 1 wherein,
the radial distance between the outer shell and inner tube (2, 8) is substantially 12 mm maximum.

3. A compact lamp according to claim 1 wherein,
said fluorescent coating (9) is on and at least partially covers the inner surface of the outer shell (2) and it constitutes the only fluorescent coating in the lamp.

4. A compact lamp according to claim 1 wherein,
the inner tube (8) is provided with a coating (21) of electrically conducting and/or reflecting material, at least partially covering the tube.

5. A compact lamp according to claim 1 wherein,
at least one of the electrodes (3, 5) is of annular shape, encircling the inner tube (8).

6. A compact lamp according to claim 5 wherein,
the annular electrode is divided into circumferentially distributed segments (11), and
the lamp includes electrical connection elements (12) operably connected with respective ones of said segments.

7. A compact lamp according to claim 6 wherein,
the lamp includes control means operable for cyclically controlling the electrode segments (11).

8. A compact lamp according to claim 7 wherein,
the control means is operable for controlling all of the electrode segments (11) together, or in groups less than all, selectively.

9. A compact lamp according to claim 1 wherein,
the inner tube (8) is of substantial diameter, is closed and does not communicate with the gas-discharge chamber, and its end opposite the base has a hollow ionizing space (14) surrounding at least one of the electrodes (5) and exposed to the gas-discharge chamber.

10. A compact lamp according to claim 9 wherein,
said ballast includes a portion that extends into the inner tube (8).

11. A compact lamp according to claim 1 wherein,
the first mentioned electrodes are designated main electrodes, and
the lamp includes excitation electrodes for heating the main electrodes (3, 5).

* * * * *